US009441437B2

(12) United States Patent
Fripp et al.

(10) Patent No.: US 9,441,437 B2
(45) **Date of Patent: *Sep. 13, 2016**

(54) ELECTRONIC RUPTURE DISCS FOR INTERVENTIONLESS BARRIER PLUG

(71) Applicant: HALLIBURTON ENERGY SERVICES, INC., Houston, TX (US)

(72) Inventors: Michael Linley Fripp, Carrollton, TX (US); Donald G. Kyle, Plano, TX (US); Jeff Huggins, Grapevine, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 329 days.

This patent is subject to a terminal disclaimer.

(21) Appl. No.: 13/896,512

(22) Filed: May 17, 2013

(65) Prior Publication Data

US 2014/0338923 A1 Nov. 20, 2014

Related U.S. Application Data

(63) Continuation of application No. 13/885,923, filed on May 16, 2013.

(51) Int. Cl.

| | |
|---|---|
| ***E21B 29/02*** | (2006.01) |
| ***E21B 33/12*** | (2006.01) |
| ***E21B 33/134*** | (2006.01) |
| ***E21B 23/04*** | (2006.01) |
| ***E21B 34/06*** | (2006.01) |

(52) U.S. Cl.

CPC ..... *E21B 29/02* (2013.01); *E21B 23/04* (2013.01); *E21B 33/12* (2013.01); *E21B 33/1208* (2013.01); *E21B 33/134* (2013.01); *E21B 34/063* (2013.01)

(58) Field of Classification Search

CPC .. E21B 33/12; E21B 33/1208; E21B 34/063; E21B 29/02; E21B 23/04; E21B 33/134; E21B 29/00

See application file for complete search history.

(56) References Cited

U.S. PATENT DOCUMENTS 3,771,603 A * 11/1973 Crowe ..... E21B 23/06 166/322

5,146,983 A 9/1992 Hromas et al.

(Continued)

OTHER PUBLICATIONS

For the American Heritage Dictionary definition: across. (n.d.) American Heritage® Dictionary of the English Language, Fifth Edition. (2011). Retrieved Jul. 18, 2016 from http://www.thefreedictionary.com/across.*

(Continued)

*Primary Examiner* — Blake Michener
*Assistant Examiner* — Wei Wang
(74) *Attorney, Agent, or Firm* — Haynes and Boone, LLP

(57) ABSTRACT

Methods and apparatus are presented for removing a degradable barrier plug positioned in a downhole axial passageway. The degradable plug is initially isolated from fluid by at least one solid, non-degradable cover. A first electronic rupture disc assembly is actuated to open a passageway to the degradable plug. A second electronic rupture disc assembly is actuated to allow a fluid, such as water from a supply chamber, to flow into contact with the plug. The plug is substantially degraded, although the cover remains. A third electronic rupture disc assembly is actuated to bend and then cover the remaining solid cover, thereby opening the axial passageway and protecting later-introduced tools.

16 Claims, 5 Drawing Sheets

(56) References Cited

U.S. PATENT DOCUMENTS

| | | | | |
|---|---|---|---|---|
| 5,479,986 | A | 1/1996 | Gano et al. | |
| 5,685,372 | A | 11/1997 | Gano | |
| 5,765,641 | A | 6/1998 | Shy et al. | |
| 5,826,661 | A | 10/1998 | Parker et al. | |
| 5,947,205 | A | 9/1999 | Shy | |
| 6,026,903 | A | 2/2000 | Shy et al. | |
| 6,076,600 | A | 6/2000 | Vick, Jr. et al. | |
| 6,095,258 | A | 8/2000 | Reese et al. | |
| 6,119,783 | A | 9/2000 | Parker et al. | |
| 6,161,622 | A * | 12/2000 | Robb et al. | 166/386 |
| 6,220,350 | B1 * | 4/2001 | Brothers et al. | 166/192 |
| 6,397,950 | B1 | 6/2002 | Streich et al. | |
| 6,450,263 | B1 | 9/2002 | Schwendemann | |
| RE39,209 | E * | 8/2006 | Barton | E21B 33/1295 166/311 |
| 7,703,511 | B2 | 4/2010 | Buyers et al. | |
| 8,220,538 | B2 * | 7/2012 | Wee | 166/179 |
| 8,631,876 | B2 * | 1/2014 | Xu et al. | 166/376 |
| 2007/0251698 | A1 | 11/2007 | Gramstad et al. | |
| 2010/0175867 | A1 | 7/2010 | Wright et al. | |
| 2010/0270031 | A1 | 10/2010 | Patel | |
| 2011/0042099 | A1 | 2/2011 | Williamson, Jr. et al. | |
| 2011/0174484 | A1 | 7/2011 | Wright et al. | |
| 2011/0174504 | A1 | 7/2011 | Wright et al. | |
| 2011/0265987 | A1 | 11/2011 | Wright et al. | |

OTHER PUBLICATIONS

Written Opinion dated Mar. 21, 2013 for Application No. PCT/US2012/053448.

International Search Report dated Mar. 21, 2013 for Application No. PCT/US2012/053448.

* cited by examiner

ELECTRONIC RUPTURE DISCS FOR INTERVENTIONLESS BARRIER PLUG

CROSS-REFERENCE TO RELATED APPLICATIONS

This Application is a Continuation of U.S. application Ser. No. 13/885,923 filed on May 16, 2013 which is the National Stage of International Application No. PCT/US2012/53448, filed Aug. 31, 2012. Each patent application identified above is herein incorporated in its entirety by reference for all purposes.

FIELD OF INVENTION

Methods and apparatus for removing a degradable barrier plug from an axial passageway in a wellbore. More specifically, methods and apparatus are disclosed for removing the plug utilizing electronic rupture disc (ERD) assemblies.

BACKGROUND OF INVENTION

It is common in hydrocarbon wells to perform well operations requiring a temporary plug of the axial passageway through a tool or tool string. For example, such barrier plugs are used in setting packers, testing the tubing string, etc. Recently, the industry has developed degradable or dissolvable plugs, or plugs otherwise removable in situ. The degradable plugs can be of various materials and degraded using various methods. A common method is to degrade a soluble plug using a fluid, often water. Since the plugs are often degradable upon contact with tubular fluids, such as wellbore or treatment fluids, the degradable plug is initially isolated from such fluids. The isolation is removed, for example, using rupture discs or other temporary covers. Some methods use ERD assemblies actuated hydraulically, by pressure pulses propagated through the wellbore fluid, etc. There remains a need for other actuating methods in conjunction with degradable barrier plugs.

SUMMARY OF THE INVENTION

In a preferred embodiment, a method is presented for removing a degradable barrier plug positioned in a downhole tubular having an axial passageway therethrough, the tubular positioned in a subterranean wellbore, the degradable barrier plug sealing the axial passageway against fluid flow. The degradable barrier plug is initially isolated from fluid in the axial passageway by at least one solid, non-degradable cover. A first electronic rupture disc assembly is actuated to open a fluid passageway to the degradable plug. A second electronic rupture disc assembly is then actuated to allow a fluid to flow through the passageway and into contact with the degradable plug. The plug is then substantially degraded by the fluid, preferably water from an annular chamber on the tubular. A third electronic rupture disc assembly is then actuated to allow a sleeve to slide over remnants of the solid, non-degradable cover. The electronic rupture disc assemblies are electrically powered, by wire or battery, are rugged enough for downhole environments, and operable to pierce or otherwise rupture an associated rupture disc. For example, a commercially available electronic rupture disc assembly is available from Halliburton Energy Services, Inc., and drives a pin through the rupture disc. In a preferred embodiment, the sliding sleeve is initially held in position by fluid pressure in a high-pressure chamber. When the third ERD assembly is actuated, the fluid flows through a flow restrictor and into a low-pressure chamber, thereby allowing the sliding sleeve to move. The sleeve moves to bend and cover the solid, non-degradable cover, thereby opening the axial passageway and protecting later-run tools.

BRIEF DESCRIPTION OF THE DRAWINGS

For a more complete understanding of the features and advantages of the present invention, reference is now made to the detailed description of the invention along with the accompanying figures in which corresponding numerals in the different figures refer to corresponding parts and in which.

DETAILED DESCRIPTION OF PREFERRED EMBODIMENTS

While the making and using of various embodiments of the present invention are discussed in detail below, a practitioner of the art will appreciate that the present invention provides applicable inventive concepts which can be embodied in a variety of specific contexts. The specific embodiments discussed herein are illustrative of specific ways to make and use the invention and do not limit the scope of the present invention. The description is provided with reference to a vertical wellbore; however, the inventions disclosed herein can be used in horizontal, vertical or deviated wellbores.

Figure 1:
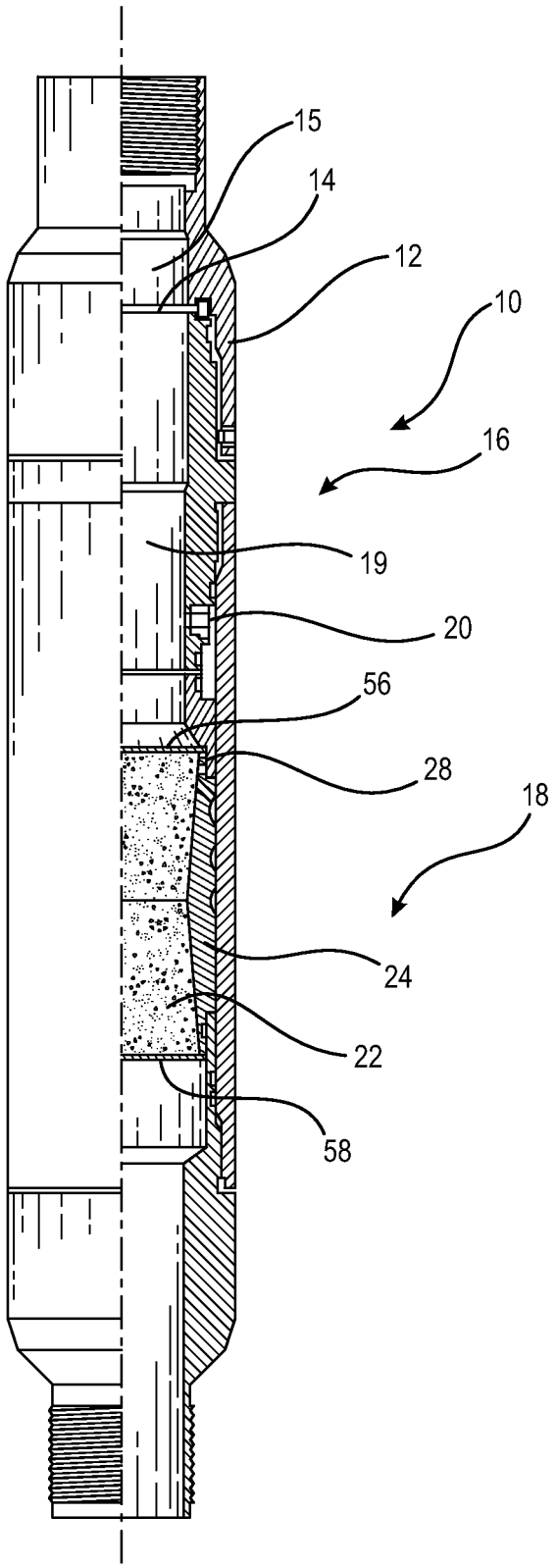
FIG. 1 is a schematic illustration of an exemplary downhole tool 10 for use in accordance with the invention.

FIG. 1 is a schematic illustration of an exemplary downhole tool 10 for use in accordance with the invention. The tool 10 is a downhole degradable plug tool to be run as an integral part of the tubing string. The particular tool shown is a Mirage (trade name) Disappearing Plug, which is commercially available from Halliburton Energy Services, Inc. More than one model of Mirage (trade name) plug is available including single and multi-cycle models. The tool will not be discussed in detail except as relates to improvements presented herein. It is understood that the invention disclosed herein can also be used with other makes and types of degradable plug tools.

The degradable plug tool 10 includes a housing 12, which may be made up of several parts, which defines an axial passageway 15 therethrough, a debris barrier 14, a water carrier 16, and a degradable plug assembly 18. The water carrier 16 defines a fluid chamber 19 housing a fluid supply, typically fresh water, on the tool. The fluid can be of various types and is selected to degrade the plug. The fluid can be fresh water, brine, caustic, alkali, diesel or other hydrocarbon, etc. The fluid chamber 19 includes a selectively openable port 20 fluidly connected to a fluid conduit which allows the fluid, once released, to flow towards the plug assembly. The water carrier 16 is optional and is preferred in situations where the in situ wellbore fluids or treatment fluids do not degrade the plug or degrade the plug efficiently.

The degradable plug assembly 18 includes degradable plug 22, plug mandrel 24, preferably a selectively openable port 28, and top and bottom isolation covers 56 and 58. Selectively openable ports 28 and 20, when open, provide fluid communication between the plug 22 and fluid chamber 19. The plug mandrel 24 maintains the plug 22 in position. The top and bottom isolation covers 56 and 58 are operable to isolate the plug from fluids above and below the plug in the axial passageway. The covers are sealed across the axial passageway, providing a layer which is impenetrable to typical wellbore and treatment fluids. Further, the covers are preferably non-degradable, in comparison to the plug, and not designed to degrade, dissolve, disappear or otherwise fail upon exposure to downhole conditions. Preferably, the covers are metal disks and welded to the housing. Since the covers will need to be removed to allow free access along the axial passageway, the covers are also movable or removable, typically after sufficient degradation of the plug. In a preferred example, the covers are a thin layer of malleable metal which can be readily bent and molded to clear the axial passageway.

The degradable plug, in a preferred embodiment, is made of a salt-sand mixture, remains solid at downhole temperatures and pressures, and is degradable in water. The term "degradable plug" as used herein includes plugs often described as dissolvable, disappearing or expendable. Operation of the plug is known in the art and not explained in detail herein.

The selectively openable ports 20 and 28, in a preferred embodiment, have rupture discs initially blocking fluid flow through the ports. The rupture discs are typically actuated (ruptured) in response to a fluid pressure signal transmitted along the axial or other fluid passageway. Rupturing of the discs opens the associated ports.

Figure 2:
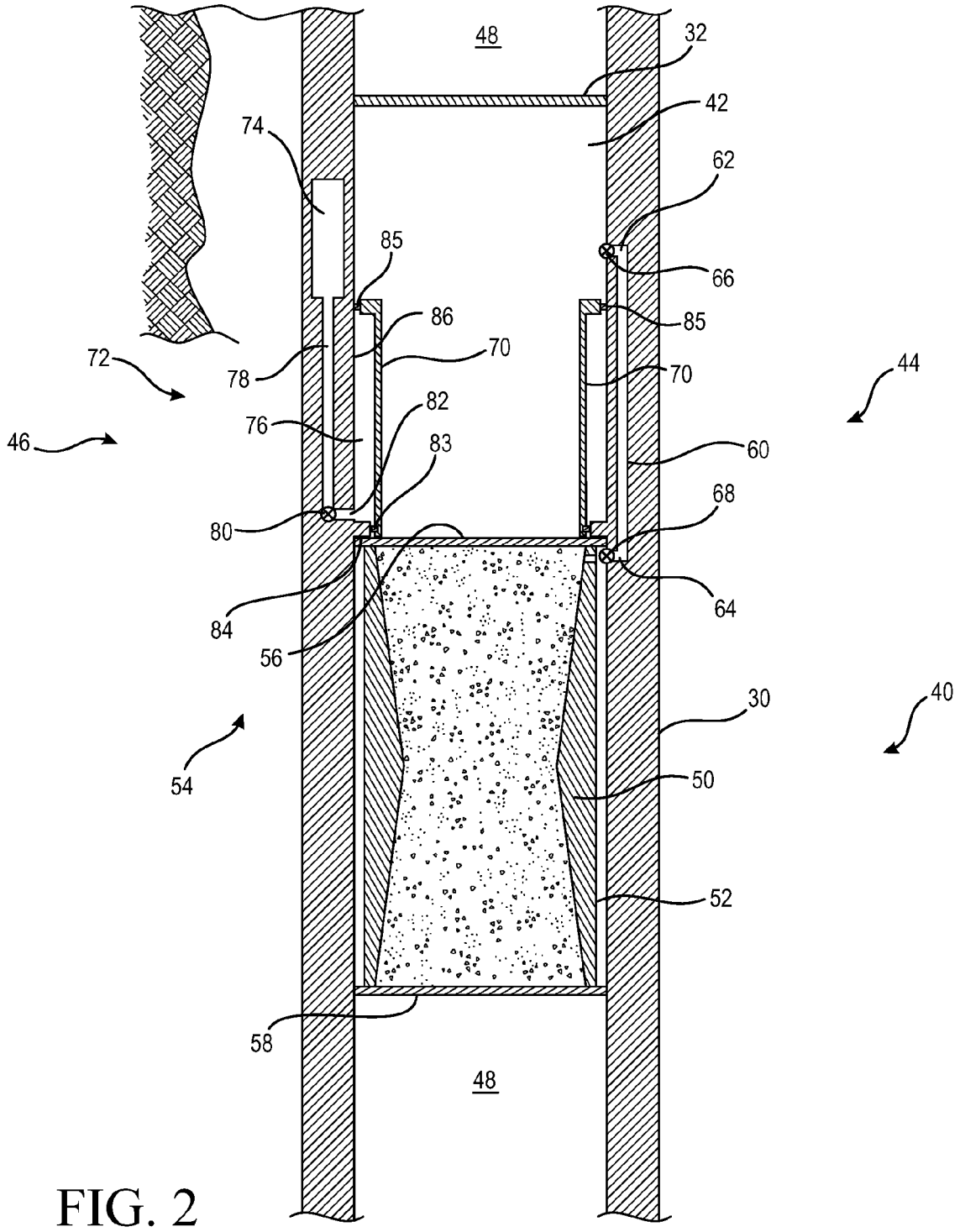
FIG. 2 is a cross-sectional schematic of a preferred embodiment of the invention.

FIG. 2 is a cross-sectional schematic of a preferred embodiment of the invention. A housing 30 accommodates a barrier device 32, a degradable plug assembly 40, a fluid chamber 42, a fluid bypass assembly 44, and a movable sleeve assembly 46. The housing 30 is typical of downhole tools and can be assembled of numerous parts sealingly connected to one another to prevent unwanted fluid flow between the axial passageway 48 and the exterior of the housing.

The barrier device 32 is disclosed in detail an in various embodiments in references incorporated herein and will not be described in detail. The barrier device 32 preferably prevents debris from entering the chamber 42. Additionally, the barrier preferably seals or substantially seals against fluid flow from the axial passageway 48 to the chamber 42. Alternate embodiments are available and, where well bore fluid is used to expend the plug, may not be necessary.

The degradable plug assembly 40 includes a degradable plug 50, a plug mandrel 52, and a plug seal assembly 54. The degradable plug is preferably a composite of sand and salt but can be made of various materials as discussed in the incorporated references. The plug mandrel is also disclosed in the incorporated references. The plug seal assembly can take many forms, as also disclosed in the incorporated references, but in a preferred embodiment the seal assembly comprises an upper end cover 56 and a lower end cover 58, each of which fluidly seals the plug from fluid in the axial passageway and/or fluid chamber above and below the plug assembly. In a preferred embodiment, the covers 56 and 58 are thin, metal disks and welded to the housing wall or shoulder.

In a preferred embodiment, the fluid chamber 42 is filled with a degrading fluid, such as fresh water, brine, etc., as explained above, prior to insertion of the plug in the wellbore. The fluid is operable to expend or degrade the plug 50. The fluid chamber is initially sealed such that the fluid therein does not come into contact with the plug. In an alternate embodiment, the substantially sealed chamber can be unnecessary and wellbore fluid in the axial passageway used to degrade the plug.

The fluid bypass assembly 44 includes a fluid bypass passageway 60 extending between a chamber port 62 and a plug access port 64 and initially sealed against fluid flow at either end by Electronic Rupture Discs (ERD) 66 and 68. Alternately, a single ERD may be used for the bypass.

The movable sleeve assembly 46 includes a sleeve 70 and an actuation assembly 72. The sleeve is slidable downwardly within the housing. Operation of sliding sleeves is common in the industry and will be understood by those of skill in the art. The embodiment described herein is exemplary. The actuation assembly, in a preferred embodiment, includes a low pressure chamber 74 and a high pressure chamber 76 connected by an actuator passageway 78. Fluid flow through the actuator passageway is initially prevented by an ERD 80 positioned in the passageway. The passageway extends between a low pressure port and a high pressure port 82. In a preferred embodiment, the low pressure chamber is filled with a gas, such as air at atmospheric pressure. The high pressure chamber is preferably filled with a liquid, such as oil. The pressure within the high pressure chamber 76 maintains the sleeve 70 in an initial position, as shown, with the sleeve above the plug, upper cover, etc. In a preferred embodiment, the high pressure chamber is defined by an interior surface of the sleeve 70, a seal element 83, a seal element seat 84 extending from the housing, a portion of the housing interior wall 86, and sealed by ERD 80 at port 82. Additional seals 85 can be used as well. The low pressure chamber 74 and actuator passageway 78 are preferably defined within the housing wall.

Upon actuation of the ERD 80, the high pressure fluid flows into or towards the low pressure chamber, thereby reducing the pressure in the high pressure chamber. The sleeve 70 is then free to slide downwardly as indicated and into contact with the plug cover 56 (and/or plug cover 58). Downward movement of the sleeve 70 is limited by a shoulder or other movement limiter.

Figure 3:
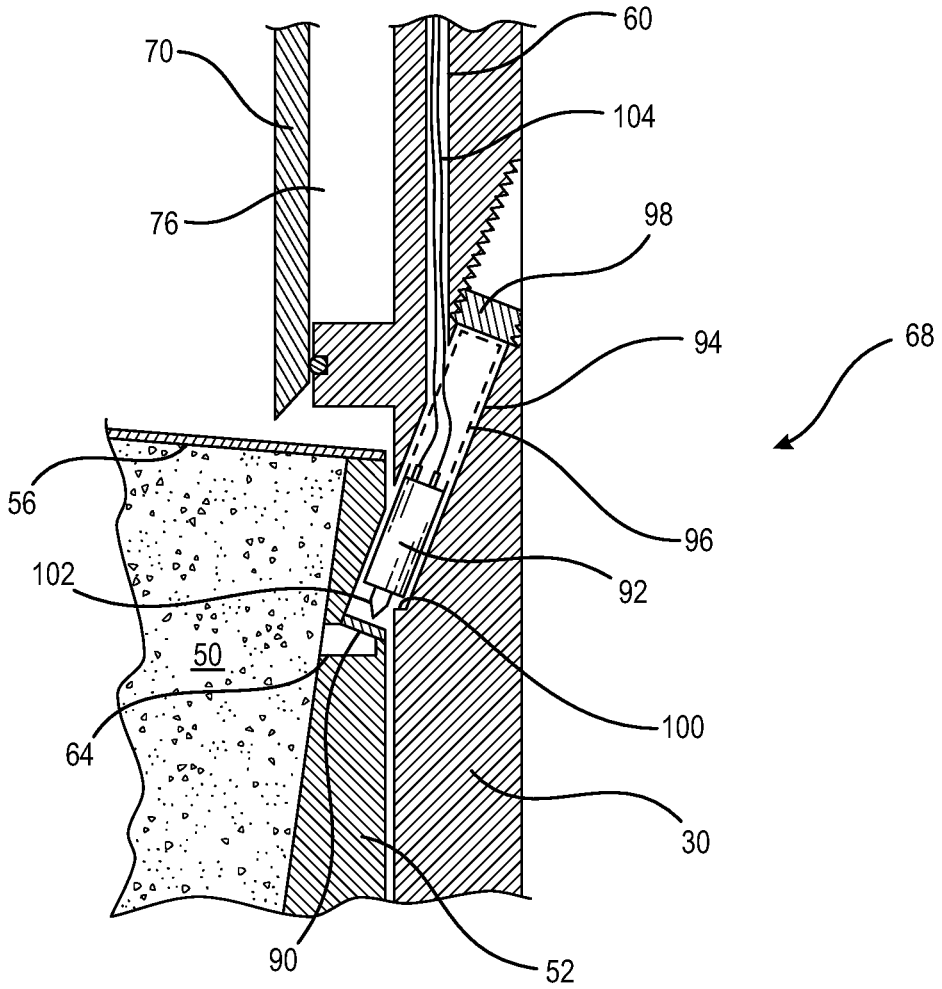
FIG. 3 is a schematic view of a detail of FIG. 2 illustrating an exemplary electronic rupture disc for use according to an embodiment of the invention.

FIG. 3 is a schematic view of a detail of FIG. 2 illustrating an exemplary electronic rupture disc for use according to an embodiment of the invention. The ERD assembly 68 is shown in a preferred embodiment in greater detail in FIG. 3. The ERD assembly includes a rupture disc 90 and an actuator assembly 92. The rupture disc 90 blocks fluid flow through the plug access port 64 until the disc is ruptured. In a preferred embodiment, the rupture disc is welded to the housing or plug mandrel. Preferably, air or other benign gas fills the space between the plug access port and rupture disc. The actuator assembly 92 is positioned in a bore 94 made for that purpose in the side wall of the housing. Spacers 96 allow for correct spacing of elements. A threaded plug 98 maintains the actuator in position and prevents fluid leakage through the bore. A shoulder or other limiter 100 is provided to position and maintain position of the actuator assembly.

The actuator assembly in a preferred embodiment includes an extendable pin 102 which is extended into contact with a pierces the rupture disc 90 upon actuation. Wires 104 provide electrical connection to an electronic package (not shown) for operation of the actuator assembly of the ERD. The wires 104 can be positioned in passageway 60 or in a separate passageway. Upon rupture, fluid communication is provided between the plug 50 and the passageway 60 through port 64 and past the now-ruptured disc and actuator assembly. Although the term rupture disc is used throughout, it is intended that the rupture disc could be any material that blocks the fluid connectivity between the spaces.

The actuator assembly, in a preferred embodiment, is a thruster assembly for rupturing discs. Actuator assemblies are commercially used by Halliburton Energy Services, Inc., and disclosure regarding their structure and use can be found in the following, which are hereby incorporated by reference for all purposes: U.S. Patent Application No. 2010/0175867, to Wright, filed Jan. 14, 2009; U.S. Patent Application Publication No. 2011/0174504, to Wright, filed Jan. 15, 2010; and U.S. Patent Application Publication No. 2011/0174484, to Wright, filed Dec. 11, 2010. Additional actuator assemblies are known in the art and will be understood by persons of skill in the art. The key components of the Electronic Rupture Disc assemblies are the barrier or rupture disc, an electrical power source, and an electrically-initiated method of breaching the barrier disc. In the preferred embodiment, the barrier is a metal rupture disc, the electrical power source is a battery, and a thruster assembly is used to puncture the barrier. In an alternative embodiment, the barrier is a glass dome and a exothermic heat source is used soften the glass to the point of failure. In an alternative embodiment, the barrier is a ceramic wafer and an electrically powered motor is used to drill through the ceramic.

Figure 4:
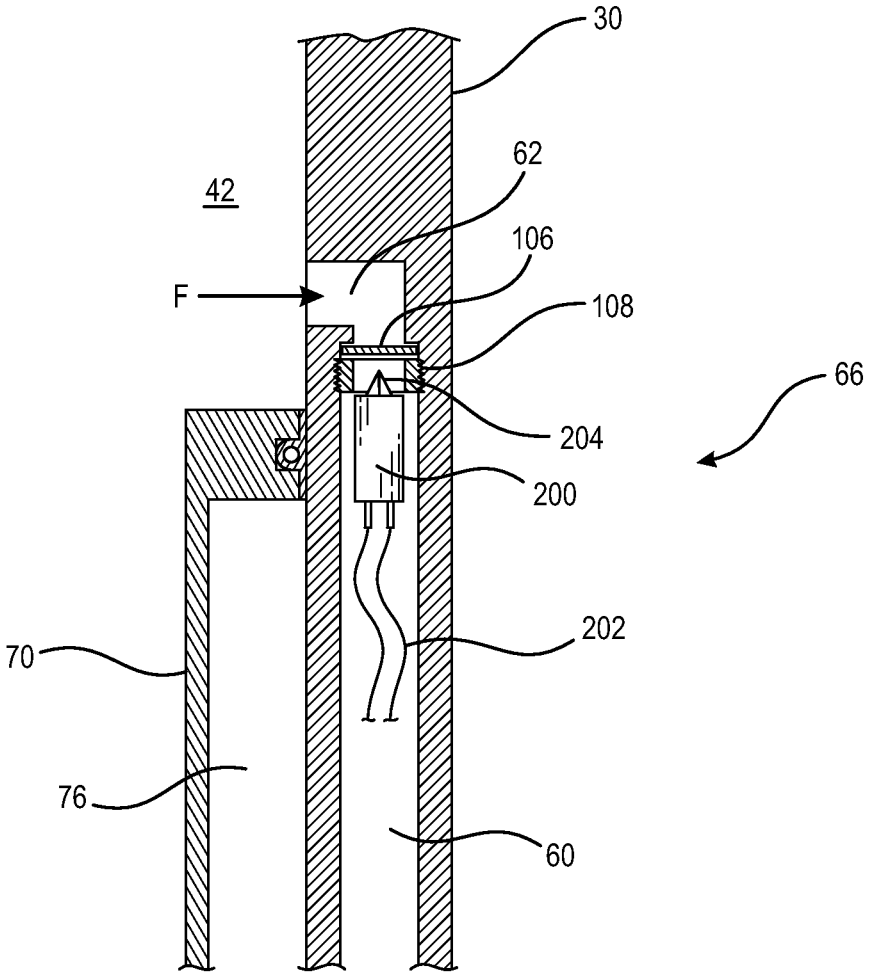
FIG. 4 is a schematic detail view of an exemplary fluid access system used in accordance with the invention.

FIG. 4 is a schematic detail view of an exemplary fluid access system used in accordance with the invention. Fluid 42 carried within the housing 30, or fluid from the axial passageway 48, is used to degrade the plug, as explained above. The fluid access port 62 is defined in the housing wall and is fluidly connected to the fluid bypass 60 upon rupture of rupture disc 106 of rupture disc assembly 66. A nut or other limiter 108 can be used to maintain the ERD assembly in position. The actuator assembly 200 is similar to the actuator assembly described above, having an extendable pin 204 for rupturing the disc, and will not be discussed further here. Wires 202 provide electrical connection to an electronic package (not shown) for operation of the actuator assembly of the ERD.

Figure 5:
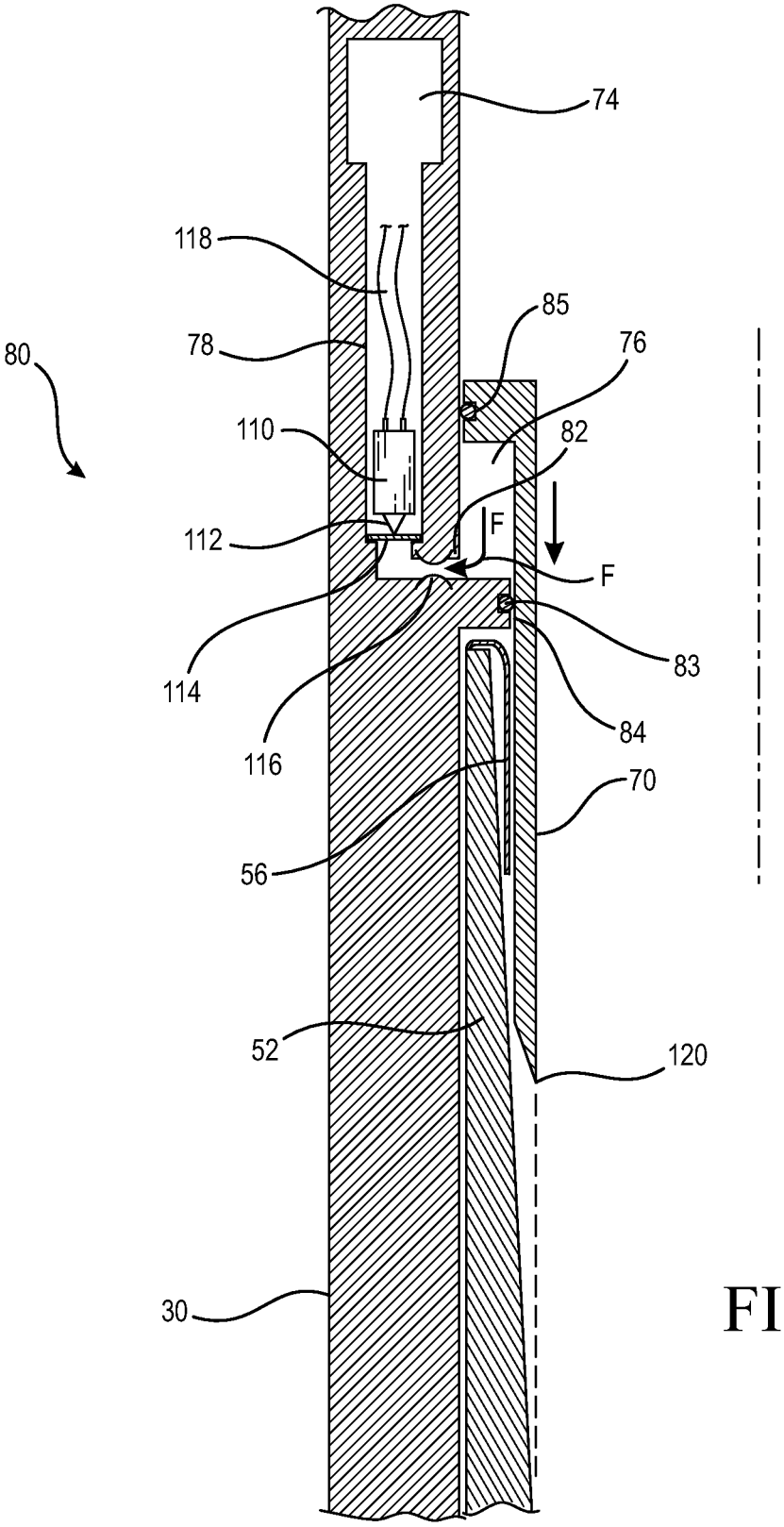
FIG. 5 is a schematic detail view of an exemplary sliding sleeve assembly for use according to an aspect of the invention It should be understood by those skilled in the art that the use of directional terms such as above, below, upper, lower, upward, downward and the like are used in relation to the illustrative embodiments as they are depicted in the figures, the upward direction being toward the top of the corresponding figure and the downward direction being toward the bottom of the corresponding figure. Where this is not the case and a term is being used to indicate a required orientation, the Specification will state or make such clear.

FIG. 5 is a schematic detail view of an exemplary sliding sleeve assembly for use according to an aspect of the invention. ERD assembly 80 is positioned along the passageway 78 between the low pressure chamber 74 (not seen) and the high pressure chamber 76. An actuator assembly 110 of the ERD assembly is operable to extend an extendable pin 112 into contact with and to rupture the rupture disc 114. Once ruptured, fluid flow is allowed through the passageway 78 between the pressure chambers. The disc 114 is preferably welded to the housing. Wires 118 provide electrical connection to an electronic package (not shown) for operation of the actuator assembly of the ERD. A flow restrictor 116 is preferably positioned in the flow passageway 78 or at the port 82.

In use, a delay is provided between the actuation of ERD assemblies 68 and 66 and actuation of the ERD assembly 80. In the interim, the fluid has substantially dissolved the plug 50. The upper cover 56 may still be intact or ruptured due to tubing pressure or other forces. To remove the cover 56, or the remnants thereof, substantially from the axial passageway 48 to allow free movement of later-introduced tools, the sleeve assembly is actuated. The ERD actuator 110 extends the pin 112 and ruptures disc 114. High pressure fluid in chamber 76 now moves into the passageway 78 towards and/or into the low pressure chamber 74. This flow is preferably restricted or metered through the fluid flow restrictor 116. Controlled release of pressure in chamber 76 allows for use of a thinner sleeve 70. The restrictor can be a nozzle, flow control device, fluidic diode, autonomous flow control device, and other such as are known in the art. The sleeve 70, now moves downwardly and bends or "wipes" the cover 56 over the plug mandrel 52 and into a position substantially clearing the axial passageway. The sleeve 70 can include a beveled end 120, if desired, which can pierce or assist in wiping the cover 56. Alternately, the sleeve end can be beveled to allow further downward movement of the sleeve and mating of the sleeve outer surface with the plug mandrel inner surface. The inner diameter of the sleeve is approximately the same as the minimum plug mandrel diameter, allowing space for the wiped cover. In alternate embodiments, the sleeve contacts and wipes both upper and lower covers, or a second sleeve assembly is provided to wipe the lower cover.

For further disclosure regarding degradable plug tools similar to that shown, their construction and use, and additional degradable plug and temporary bore plug tools, see the following, which are hereby incorporated herein by reference for all purposes: *Mirage* (trade name) *Disappearing Plug and Autofill Sub*, Halliburton Completion Tools, Completion Solutions (2010) (available on-line); *Halliburton Well Completion Catalog*, Subsurface Flow Control Systems, p. 8-40 (2011); U.S. patent application Ser. No. 13/045,800, Flow Control Screen Assembly Having Remotely Disabled Reverse Flow Control Capability, by Veit, application date Mar. 11, 2011; U.S. patent application Ser. No. 13/041,611, Check Assembly For Well Stimulation Operations, by Veit, application date Mar. 7, 2011; U.S. Patent Application Publication 2007/0251698, Temporary Well Zone Isolation, by Gramstad, et al, published Nov. 1, 2007; U.S. Patent Application Publication US2011/0265987, Downhole Actuator Apparatus Having A Chemically Activated Trigger, by Wright, published Nov. 3, 2011; U.S. Pat. No. 6,450,263, Remotely Actuated Rupture Disk, by Schwendemann, issued Sep. 17, 2002; U.S. Pat. No. 6,076,600, Plug Apparatus Having A Dispersible Plug Member And A Fluid Barrier, by Vick, Jr., et al, issued Jun. 20, 2000; U.S. Pat. No. 6,095,258, Pressure Actuated SafetySwitch For Oil Well Perforating, by Reese, et al, issued Aug. 1, 2000; U.S. Pat. No. 5,146,983, Hydrostatic Setting Tool Including A Selectively Operable Apparatus Initially Blocking An Orifice Disposed Between Two Chambers and opening In Response To A Signal, by Hromas, et al, issued Sep. 15, 1992; U.S. Pat. No. 5,947,205, Linear Indexing Apparatus With Selective Porting, by Shy, issued Sep. 7, 1999; U.S. Pat. No. 6,119,783, Linear Indexing Apparatus And Methods Of Using Same, by Parker et al, issued Sep. 19, 2000; U.S. Pat. No. 5,479,986, Temporary Plug System, Gano, et al, issued Jan. 2, 1996; U.S. Pat. No. 6,397,950, Apparatus And Method For Removing A Frangible Rupture Disc or Other Frangible Device From A Wellbore Casing, by Streich, et al, issued Jun. 4, 2002; U.S. Pat. No. 5,826,661, Linear Indexing Apparatus And Methods Of Using Same, by Parker, et al, issued Oct. 27, 1998; U.S. Pat. No. 5,685,372, Temporary Plug System, by Gano, issued Nov. 11, 1997; U.S. Pat. No. 6,026,903, Bidirectional Disappearing Plug, by Shy, et al, issued Feb. 22, 2000; and U.S. Pat. No. 5,765,641, Bidirectional Disappearing Plug, by Shy, et al, issued Jun. 16, 1998.

Exemplary methods of use of the invention are described, with the understanding that the invention is determined and limited only by the claims. Those of skill in the art will recognize additional steps, different order of steps, and that not all steps need be performed to practice the inventive methods described.

In preferred embodiments, the following methods are disclosed. A method for removing a degradable barrier plug positioned in a downhole tubular having an axial passageway therethrough, the tubular positioned in a subterranean wellbore, the degradable barrier plug sealing the axial passageway against fluid flow, the degradable barrier plug isolated from fluid in the axial passageway by at least one solid, non-degradable cover, the method comprising the steps of: actuating a first electronic rupture disc assembly to open a fluid passageway to the degradable plug; optionally actuating a second electronic rupture disc assembly to allow a fluid to flow through the passageway and into contact with the degradable plug; substantially degrading the degradable plug; and optionally actuating a third electronic rupture disc assembly to allow a sleeve to slide over remnants of the solid, non-degradable cover. Additionally, the method can include wherein the step of actuating a first electronic rupture disc assembly further comprises the step of piercing a first rupture disc; wherein the step of piercing a first rupture disc further comprises moving a pin through the first rupture disc, the movement powered electronically; wherein the first rupture disc is initially positioned to block flow through a plug passageway extending from the plug to the first rupture disc; wherein the plug passageway is initially filled with a gas in the chamber defined between the plug and the first rupture disc; further comprising the step of supplying electric power through electric conduits to the first, second and third electronic rupture disc assemblies; wherein the step of actuating a second electronic rupture disc assembly further comprises the step of piercing a second rupture disc; wherein the step of piercing a second rupture disc further comprises moving a pin through the second rupture disc, the movement powered electronically; wherein the second rupture disc is positioned to block fluid flow through a fluid supply passageway extending from a fluid supply to the second rupture disc; wherein a first rupture disc of the first electronic rupture disc assembly is initially positioned to block flow through a plug passageway extending from the degradable plug to the first rupture disc, and wherein the second rupture disc is positioned to block fluid flow through a fluid supply passageway extending from a fluid supply to the second rupture disc; wherein the fluid supply passageway is in fluid communication with the plug passageway; further comprising the step of flowing a fluid from a water supply through the fluid supply passageway and into contact with the degradable plug; wherein the fluid is water; wherein the water supply is an annular chamber of water positioned on the downhole tubular; wherein the step of actuating a third electronic rupture disc assembly further comprises piercing a third rupture disc; wherein the third rupture disc initially separates a high pressure chamber filled with high pressure fluid and a low pressure chamber filled with low pressure fluid; wherein the high pressure fluid prevents the sleeve from sliding; wherein the step of piercing the third rupture disc allows the fluid in the high pressure chamber to flow out of the high pressure chamber, and thereby allows the sleeve to slide over remnants of the solid, non-degradable cover; wherein the solid, non-degradable cover is made of metal; and wherein flow of the fluid from the high pressure chamber is regulated by a flow restrictor.

Persons of skill in the art will recognize various combinations and orders of the above described steps and details of the methods presented herein. While this invention has been described with reference to illustrative embodiments, this description is not intended to be construed in a limiting sense. Various modifications and combinations of the illustrative embodiments as well as other embodiments of the invention will be apparent to persons skilled in the art upon reference to the description. It is, therefore, intended that the appended claims encompass any such modifications or embodiments.

It is claimed:

1. A method for removing a plug positioned to block fluid flow through a passageway in a downhole tubular positioned in a subterranean wellbore, the plug isolated from fluid in the passageway by at least one cover, the method comprising the steps of:

actuating an electronic rupture disc assembly to open a fluid bypass to the plug, the rupture disk assembly having a rupture disc initially positioned to block fluid flow along the fluid bypass between the plug and the rupture disc;

allowing a degrading fluid to flow from a fluid chamber and through the fluid bypass, thereby contacting the plug, wherein the fluid chamber extends across the passageway; and substantially degrading the plug using the degrading fluid.

2. The method of claim 1, further comprising the step of supplying electric power to the electronic rupture disc assembly.

3. The method of claim 1, further comprising the step of delaying actuation of an additional electronic rupture disc assembly until substantial degradation of the plug.

4. The method of claim 3, further comprising the step of actuating the additional rupture disc assembly to allow substantial removal of the cover from the passageway.

5. The method of claim 4, wherein the step of substantially removing the cover further comprises mechanically removing the cover.

6. The method of claim 5, further comprising the step of flowing high pressure fluid from a high pressure chamber into a low pressure chamber in response to actuation of the additional rupture disc assembly.

7. The method of claim 6, further comprising the step of moving a sleeve over at least a portion of the cover in response to the step of flowing high pressure fluid from the high pressure chamber.

8. The method of claim 7, wherein the step of moving the sleeve further includes sliding the sleeve longitudinally along the passageway and substantially removing the cover from the passageway.

9. The method of claim 1, wherein at least a portion of the fluid bypass is initially filled with air between the plug and the rupture disc.

10. The method of claim 1, wherein the degrading fluid is at least one of fresh water, brine, and hydrocarbon fluid.

11. The method of claim 1, wherein the plug is initially fluidly isolated.

12. An apparatus for use in a subterranean wellbore and for removing a degradable plug from a passageway extending along a downhole tubular, the degradable plug for blocking fluid flow through the passageway, the apparatus comprising:

a fluid chamber positioned within the passageway, the fluid chamber having a degrading fluid therein for degrading the plug;

a first electronic rupture disc assembly along a fluid bypass having a first rupture disc for selectively blocking flow of the degrading fluid from the fluid chamber through the fluid bypass; and a second electronic rupture disc assembly along the fluid bypass having a second rupture disc for selectively blocking flow of the degrading fluid flowing through the fluid bypass and into contact with the degradable plug.

13. An apparatus as in claim 12, further comprising a cover protecting the degradable plug from the degrading fluid.

14. An apparatus as in claim 12, further comprising a movable member operable to substantially remove a degradable plug cover from the passageway.

15. An apparatus as in claim 14, wherein the movable member is a sleeve.

16. An apparatus as in claim 14, wherein the movable member is retained in an initial position by a high pressure fluid in a high pressure chamber and further comprising a third electronic rupture disc assembly having a third rupture disc for selectively blocking flow of the high pressure fluid from the high pressure chamber.

* * * * *